US012582859B1

(12) United States Patent
Yevseyev

(10) Patent No.: US 12,582,859 B1
(45) Date of Patent: Mar. 24, 2026

(54) ADJUSTABLE JUMP ROPING SYSTEM

(71) Applicant: Jake Yevseyev, Brooklyn, NY (US)

(72) Inventor: Jake Yevseyev, Brooklyn, NY (US)

( * ) Notice: Subject to any disclaimer, the term of this patent is extended or adjusted under 35 U.S.C. 154(b) by 0 days.

(21) Appl. No.: 18/747,984

(22) Filed: Jun. 19, 2024

Related U.S. Application Data

(60) Provisional application No. 63/524,151, filed on Jun. 29, 2023.

(51) Int. Cl.
*A63B 5/20* (2006.01)

(52) U.S. Cl.
CPC ..... *A63B 5/20* (2013.01); *A63B 2225/09* (2013.01)

(58) Field of Classification Search
CPC ..... A63B 5/20; A63B 2225/09
See application file for complete search history.

(56) References Cited

U.S. PATENT DOCUMENTS 3,140,871 A * 7/1964 Liquori ..... A63B 5/22 473/576
8,684,892 B1 * 4/2014 Ihli ..... A63B 5/20 482/81
2007/0129220 A1 * 6/2007 Bardha ..... A63B 5/20 482/1
2013/0324367 A1 * 12/2013 Lam ..... A63H 33/18 482/2
2016/0271478 A1 * 9/2016 Kabes ..... A63B 17/04
2017/0128774 A1 * 5/2017 Levine ..... A63B 21/0428
2018/0353811 A1 * 12/2018 Tam ..... A63B 1/00
2019/0030390 A1 * 1/2019 Chuang ..... A63B 21/0004
2020/0384302 A1 * 12/2020 Rowls ..... A63B 71/0036
2021/0023413 A1 * 1/2021 Nurge ..... A63B 21/4034
2023/0037024 A1 * 2/2023 De Roeck ..... A63B 5/20
2024/0050807 A1 * 2/2024 Zhang ..... A63B 71/0605
2025/0032846 A1 * 1/2025 Johnson ..... A63B 21/4019

* cited by examiner

*Primary Examiner* — Sundhara M Ganesan
(74) *Attorney, Agent, or Firm* — Malloy & Malloy, P.L.; Rafay Asrar

(57) ABSTRACT

The present invention provides an adjustable jump roping system designed for enhanced usability, portability, and storage convenience. The system comprises a pair of adjustable wristbands and removable housings that function as handles, each containing a coiled rope segment. The housings feature a button mechanism for controlled extension and retraction of the rope. The rope segments are equipped with click-and-lock connectors, allowing secure and easy attachment and detachment. Additionally, the rope segments include engraved numerical markings for precise length adjustment. The wristbands can be made from various materials and may include additional features such as integrated storage pouches and reflective elements. This innovative jump roping system addresses the limitations of traditional ropes by offering a more user-friendly and versatile solution for a wide range of exercise routines and environments.

20 Claims, 11 Drawing Sheets

ADJUSTABLE JUMP ROPING SYSTEM

CLAIM OF PRIORITY

This application claims the benefit of United States Provisional Patent Application 63/524,151 filed on Jun. 29, 2023, which is incorporated by reference herein in its entirety.

BACKGROUND OF THE INVENTION

Field of the Invention

The present invention relates to the field of physical exercise equipment, and more specifically to jump roping systems. The invention aims to provide an adjustable, user-friendly, and portable jump roping system with features that enhance usability, storage, and overall convenience. The system is designed to address the limitations of traditional jump ropes by incorporating innovative mechanisms for easy adjustment, secure connections, and efficient storage, making it suitable for a wide range of users and exercise environments.

DESCRIPTION OF THE RELATED ART

Jump roping, or skipping, is a form of cardiovascular exercise that has been practiced across cultures for centuries. Its popularity stems from numerous health benefits it offers such as improved cardiovascular fitness, coordination, agility, and endurance. Jump roping is a versatile exercise, suitable for individuals of different fitness levels, allowing for varying intensities and durations.

Traditional jump ropes comprise a length of rope with handles attached at each end. While the simplicity of this design has contributed to its wide usage, it presents several limitations. One significant drawback is the fixed length of the rope, making it less adaptable to users of varying heights and skill levels. This lack of adjustability can limit the effectiveness of the exercise and increase the risk of injury. Furthermore, the need to carry the entire length of the rope for exercising in different locations can be cumbersome and limit the portability of traditional jump ropes.

Over the years, several modifications have been introduced to address these drawbacks.

Adjustable jump ropes allow the length to be changed, providing some flexibility for users of different heights. However, the adjustment process can be complex, often requiring additional equipment or parts, which can discourage some users.

Collapsible or disassemble handles have also been introduced to improve portability.

However, such modifications can compromise the durability and structural integrity of the rope, making it susceptible to damage and reducing its lifespan. Furthermore, these modifications do not typically address the issue of convenient storage and transport, which remains a significant challenge.

Existing jump ropes, even those with compact designs, often become entangled or knotted, complicating their use and maintenance. Untangling a knotted rope can be a frustrating task that may deter users from maintaining a consistent exercise routine. The inconvenience of storing and carrying a conventional jump rope, due to its length and flexibility, is another issue that has not been fully addressed in the prior art.

Some prior art has proposed solutions for the storage problem, such as providing a separate carrying case or bag. However, this adds to the overall bulk and decreases the convenience of using and transporting the jump rope.

In the realm of prior art, there are also examples of electronic jump ropes that replace the rope with sensors and provide a digital skipping experience. While these designs eliminate the issues of tangling and storage, they also remove the tactile experience of a physical rope, which some users prefer. They also require a power source, adding another layer of complexity to the use and maintenance of the equipment.

Thus, while there have been various attempts to improve upon the traditional jump rope design, significant shortcomings remain. Most solutions to date have not fully addressed the need for a user-friendly, adjustable, portable, and easily storable jump roping system. Additionally, many of the improvements offered in prior designs come with their own set of drawbacks, such as increased complexity, reduced durability, or loss of the traditional jumping rope experience.

It is within this context that the present invention is proposed, aiming to overcome the shortcomings of prior art and provide an improved jump roping system.

SUMMARY OF THE INVENTION

The present invention introduces an innovative jump roping system featuring magnetically coupled removable handles. The system comprises two wristbands, each designed to hold a handle that includes a portion of the jump rope. Each handle contains a cylindrical housing that accommodates the rope in a coiled manner, preventing complete release or recoil of the rope. The magnetic system within each handle allows the two rope portions to connect and be used as a traditional jump rope. The adjustability and portability of this system provide a novel approach to the design and functionality of jump ropes, addressing many of the limitations inherent in previous designs.

The present invention offers several significant advantages over prior art. First and foremost, the use of magnetically coupled removable handles enhances user flexibility, allowing the rope length to be easily adjusted to accommodate different user heights and skill levels. This feature also promotes safer use by reducing the risk of tripping or injury associated with fixed-length ropes. Additionally, the novel design allows for improved portability. By accommodating the rope within the removable handles that are secured around the user's wrists, the invention reduces the need to carry a large, unwieldy rope, thus making it easier for users to exercise in various locations. Furthermore, the integrated storage system within the handles simplifies storage and prevents tangling, overcoming a major shortcoming in traditional and modified jump ropes. Lastly, the invention maintains the tactile experience of a physical rope, addressing a limitation found in electronic or sensor-based alternatives. Overall, the invention provides a more user-friendly, convenient, and versatile jump roping system.

In a first implementation of the invention, a jump roping system comprising a pair of adjustable wristbands, each configured to be worn around a user's wrist and incorporating an attachment point for securing a removable housing us provided. The system also includes a pair of removable housings, each housing comprising a grip portion designed for hand-holding and a cylindrical housing affixed to the grip portion. The cylindrical housing is structured to hold a portion of a jump rope in a coiled configuration and includes a mechanism to control the extension and retraction of the rope segment. Additionally, a segment of rope is located within each cylindrical housing, with each rope segment having a connector at one end. These connectors are designed to securely attach the rope segments together and to allow for easy disconnection.

In a second aspect, the wristbands may be made of an elastic material.

In another aspect, the wristbands may be adjustable to accommodate different wrist sizes.

In another aspect, the attachment points on the wristbands may be designed to secure the removable handles via a snap-fit mechanism.

In another aspect, the handle portion may be ergonomically designed for comfortable grip.

In another aspect, the cylindrical housing may include a transparent portion allowing the user to visually assess the amount of rope remaining inside.

In another aspect, the cylindrical housing may include an opening mechanism to allow the user to manually adjust the amount of rope to be released.

In another aspect, the tapered inlet/outlet of the cylindrical housing may include a friction surface to regulate the extension and retraction of the rope.

In another aspect, the rope is made of a durable material selected from a group consisting of nylon, polyester, and polypropylene.

In another aspect, the rope is coated with a material to reduce friction.

In another aspect, the rope segments in each handle have different lengths to accommodate users of varying heights.

In another aspect, the system may further comprise a counter mechanism to keep track of the number of jumps performed by the user.

In another aspect, the system may further comprise a heart rate monitor integrated within the wristbands.

In another aspect, the system may further comprise an electronic display on one or both of the wristbands to provide exercise data to the user.

In another aspect, the wristbands, removable handles, or both include a customization feature, such as changeable colors, patterns, or user identifiers.

In another aspect, the removable handles are weighted to provide additional resistance during use.

In another aspect, the system may further comprise a charging feature for powering electronic components integrated within the system.

In another aspect, the system may further comprise wireless connectivity feature to link the system with other devices for data sharing or remote tracking.

In another aspect, the removable handles, wristbands, or both are made of a water-resistant or waterproof material to withstand sweat or outdoor elements.

In another aspect, the system may further comprise a storage pouch integrated into each of the wristbands.

In another aspect, the storage pouch is made of a flexible and stretchable material.

In another aspect, the storage pouch is secured via a zipper, Velcro, snap-fit, or other closure mechanism.

In another aspect, the system may further comprise a cap with two inlets.

In another aspect, the cap may be designed to hold the end portion of each rope portion of each handle when the system is not in use.

In another aspect, the cap may be made from a durable material capable of withstanding frequent insertion and removal of the rope portions.

In another aspect, the cap may further comprise a locking mechanism to secure the end portions of the rope portions in place when the system is not in use.

In another aspect, the cap may further comprise a mechanism for quick release of the end portions of the rope portions when the system is to be used.

In another aspect, wherein the mechanism to control the extension and retraction of the rope segment may include a button that can be slid or pressed to release the rope segment.

In another aspect, wherein the button mechanism may allow the user to extract the rope to a desired length and then lock the rope in place by returning the button to its original position.

In another aspect, wherein the button mechanism may allow the user to retract the rope back into the cylindrical housing by holding the button and pushing or sliding it.

In another aspect, wherein the connectors at the ends of the rope segments may consist of male and female parts that click together to form a secure connection.

In another aspect, wherein the connectors may include a release mechanism that allows the rope segments to be separated by pushing at the connection point.

In another aspect, wherein the cylindrical housing may include a tapered inlet/outlet to restrict the rope from fully extending or completely recoiling into the housing.

In another implementation of the invention, a method for using a jump roping system comprises securing two adjustable wristbands around a user's wrists, each wristband having a removable housing attached. The method includes extending a rope portion from each housing, where each rope portion is housed in a cylindrical housing within the grip portion and is prevented from fully extending or completely recoiling into the housing due to a mechanism to control the extension and retraction of the rope. The rope portions, equipped with click-and-lock connectors, are securely attached by clicking together the male and female parts, forming a full-length jump rope. The user then utilizes the connected rope for jump roping exercises. After use, the rope portions are easily disconnected by pushing a release button at the connection point and recoiled back into the cylindrical housing within the grips, ensuring the system is ready for convenient storage and future use.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENT

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
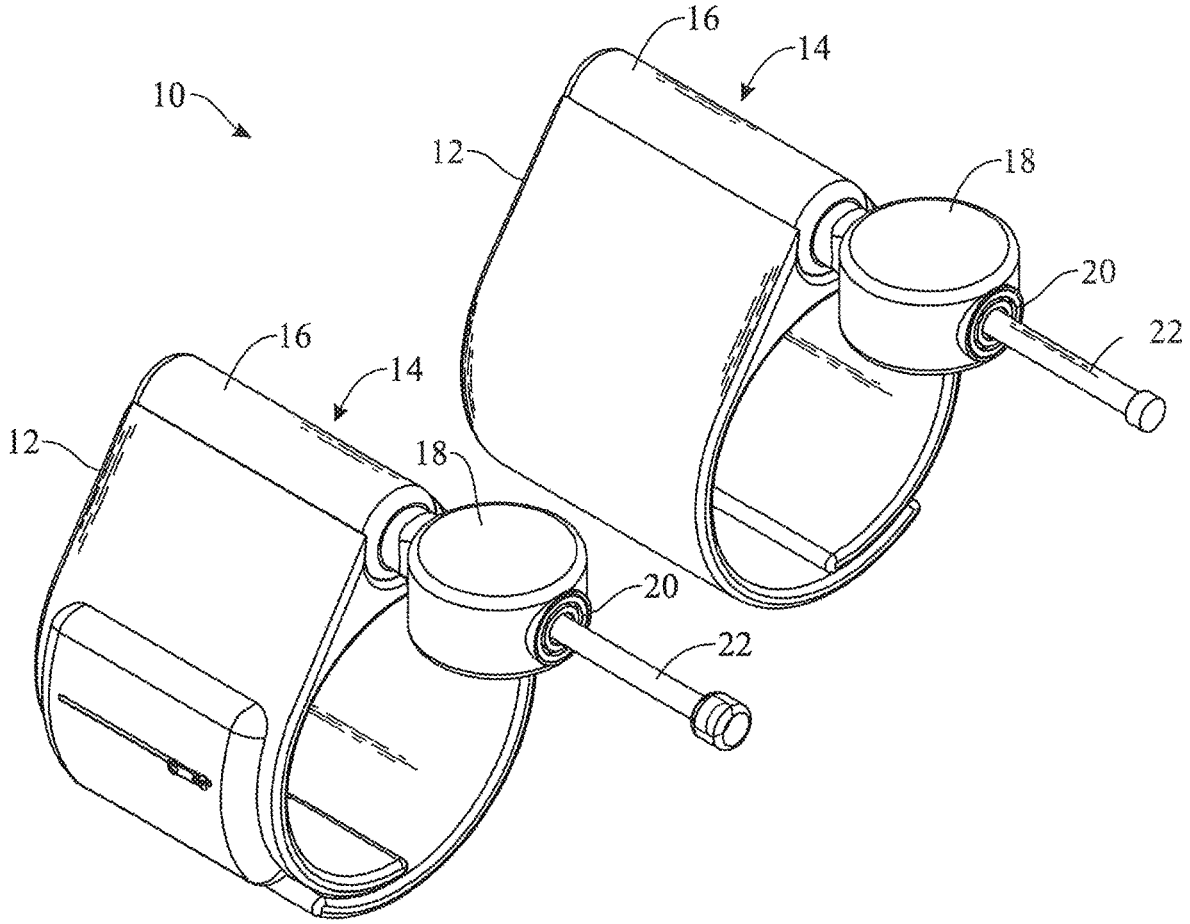
FIG. 1 presents a perspective view of a jump roping system, in accordance with a first illustrative embodiment of the invention.

Referring now to the figures, wherein like reference numerals designate identical or corresponding parts throughout the several views, FIG. 1 presents a perspective view of a jump roping system 10, in accordance with a first illustrative embodiment of the invention. This inventive system incorporates several innovative features to offer users an improved jump roping experience, addressing various limitations associated with traditional and modified jump ropes currently available in the market. The primary goal of this invention is to provide a versatile, user-friendly, and portable jump rope system that is easy to use, store, and transport.

The jump roping system 10 includes a pair of wristbands 12 and a pair of removable handles 14, as depicted in FIG. 1. Each of the wristbands 12 is designed to be secured around a user's wrist. These wristbands 12 are not only adjustable to fit various wrist sizes but are also designed to be versatile and adaptable to different user needs. They can be made from a wide range of materials, such as elastic, silicone, or fabric, depending on the desired level of comfort, flexibility, and durability. The wristbands 12 can also feature a secure yet adjustable closure mechanism like a buckle, Velcro, or snap-fit, enabling easy size adjustment and a secure fit.

The innovative design of the wristbands 12 enhances user comfort and flexibility but also facilitates storage and transportation of the system 10. This is because the handles 14 can be attached to the wristbands 12 when not in use, either via a slot, a loop, or a pocket incorporated into the wristbands 12. This feature can be particularly beneficial for users who like to exercise on the go, ensuring that their jump roping system 10 is always at hand. The wristbands' adjustability and secure fit are designed to accommodate a wide range of wrist sizes and preferences, ensuring that the system remains comfortable and effective during use.

Figure 2:
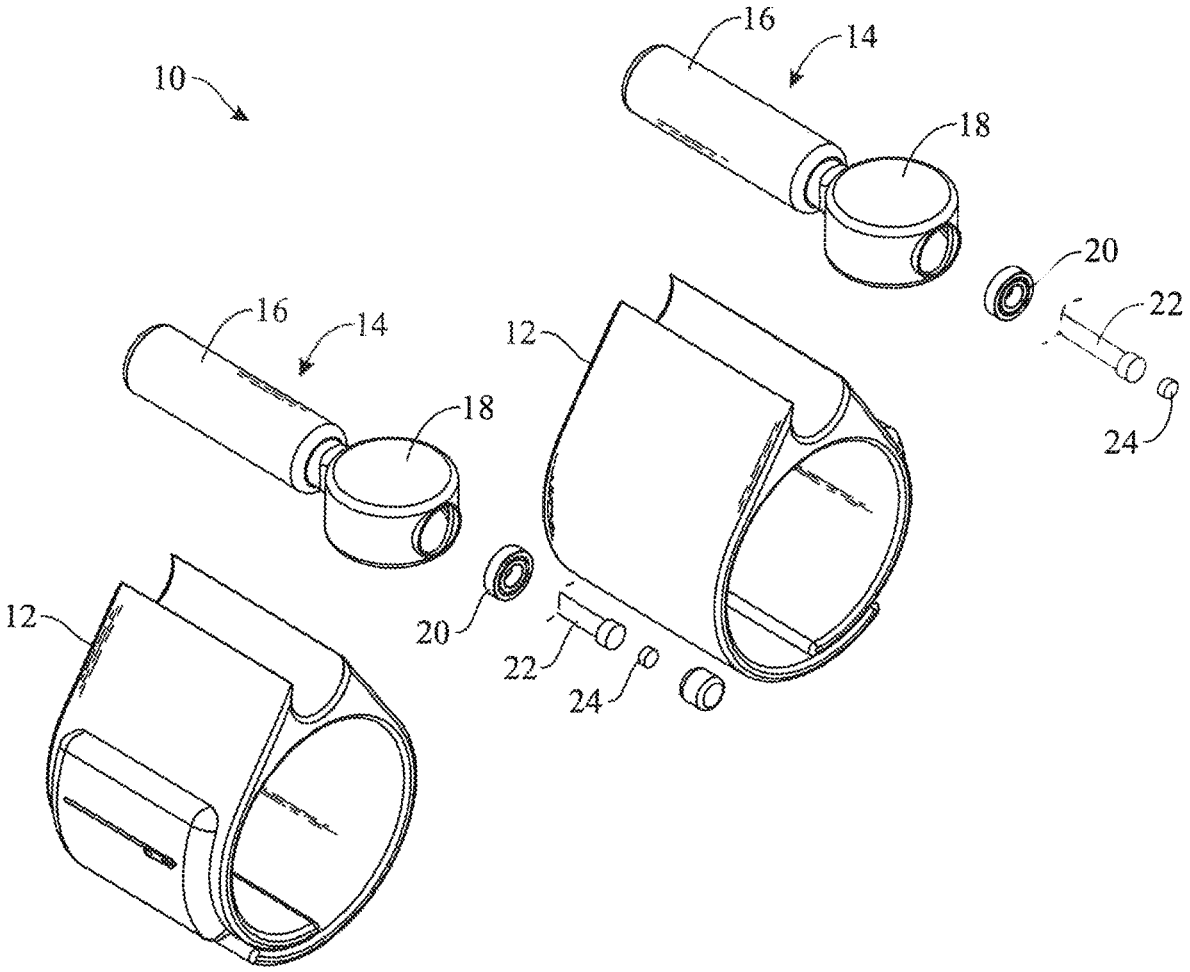
FIG. 2 presents an exploded view of the jump roping system illustrated in FIG. 1, shown with the components parts including a pair of wristbands, a pair of handles, and a holdable portion, a housing, an inlet/outlet, a segment of rope, and a magnet for each of the pair of handles.

Now, referring to FIG. 2, an exploded view of the jump roping system 10 depicted in FIG. 1 reveals various component parts of the system 10. Each of the handles 14 includes a hand-holdable portion 16, a cylindrical housing 18, a tapered inlet/outlet 20, a segment of rope 22, and a magnet 24. These components work together to provide a seamless and efficient jump roping experience. The design ensures that the rope remains untangled and easily extendable and retractable.

The hand-holdable portion 16 is ergonomically designed for a comfortable grip. It May have a non-slip surface or coating to enhance grip and reduce the chance of the handle 14 slipping from the user's hand during vigorous exercise. The hand-holdable portion 16 can be made from various materials, such as plastic, rubber, metal, or a combination thereof, depending on the desired durability, weight, and tactile feel. Furthermore, the hand-holdable portion 16 can come in different shapes and sizes, including cylindrical, rectangular, or even custom forms, to cater to different user preferences and needs. This ergonomic design is crucial for ensuring that users can maintain a firm and comfortable grip during their workouts, reducing the risk of hand fatigue or slippage.

The cylindrical housing 18, affixed to the hand-holdable portion 16, is an essential component of the jump roping system 10. It is adapted to accommodate the segment of rope 22 in a coiled configuration, keeping it neatly contained and free from tangles. The housing 18 can be made from a variety of sturdy materials such as metal, hard plastic, or even reinforced composites to withstand the repetitive coiling and uncoiling of the rope 22 during use. The housing's durability is important to ensure that it can withstand the physical demands of regular exercise, while its design prevents the rope from becoming tangled or damaged during storage and use.

The tapered inlet/outlet 20 of the cylindrical housing 18 plays a crucial role in controlling the extension and retraction of the rope 22. By preventing the rope 22 from either completely extending or fully recoiling into the housing 18, the inlet/outlet 20 ensures a consistent length of rope 22 during use. This consistency not only allows users to perform their exercise routine uninterrupted but also eliminates potential safety hazards associated with unexpected changes in rope length. The tapered design ensures that the rope extends and retracts smoothly, preventing abrupt movements that could disrupt the user's workout.

The segment of rope 22 extends from the cylindrical housing 18 through the inlet/outlet 20. The rope 22 can be made from various durable materials capable of withstanding frequent use and friction. While nylon, polyester, and polypropylene are some potential materials, other options include but are not limited to leather, wire, or even high-strength fiber materials. The segment of rope 22 can be of any suitable length, diameter, and weight depending on user preferences, fitness levels, and the specific type of exercise routine. The choice of material for the rope 22 is critical for ensuring that it remains durable and functional over time, even with frequent use.

One of the defining features of the jump roping system 10 is the inclusion of a magnet 24 at the end of each segment of rope 22. The magnet 24 is selected for its strong magnetic properties, allowing for a secure connection during use while also enabling easy separation when the exercise is completed. Various types of magnets, such as neodymium magnets, ceramic magnets, or even magnetic alloys, can be used, depending on the desired magnetic strength, durability, and cost considerations. The magnet's design ensures that the rope segments connect easily and securely, providing a reliable connection that enhances the user's jump roping experience.

Figure 3:
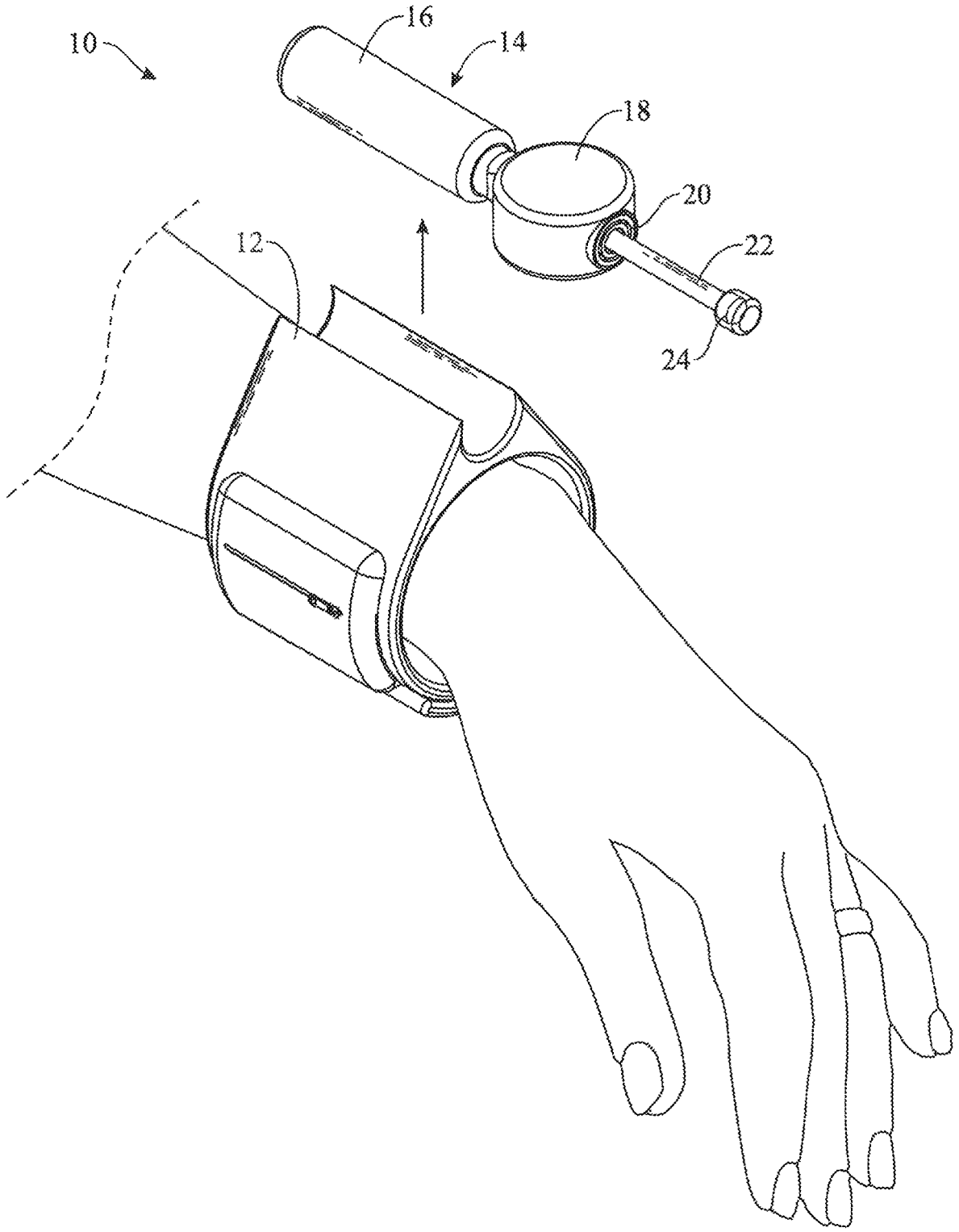
FIG. 3 presents a perspective view of the jump roping system illustrated in FIG. 1, shown with one wristband being place on the wrist of a user, wherein the handle is being removed from the wristband.

FIG. 3 illustrates the process of preparing the jump roping system 10 for use. As shown in this figure, one of the wristbands 12 is placed on the wrist of a user. The handle 14 can then be easily removed from the wristband 12, allowing the user to conveniently extend the rope 22 for use. The adaptability of the system 10 to the user's wrist size ensures a comfortable fit, thereby enhancing the user's exercise experience. The ease of attaching and detaching the handles 14 from the wristbands 12 makes the system highly convenient for users who need to transition quickly between different exercises or activities.

Figure 4:
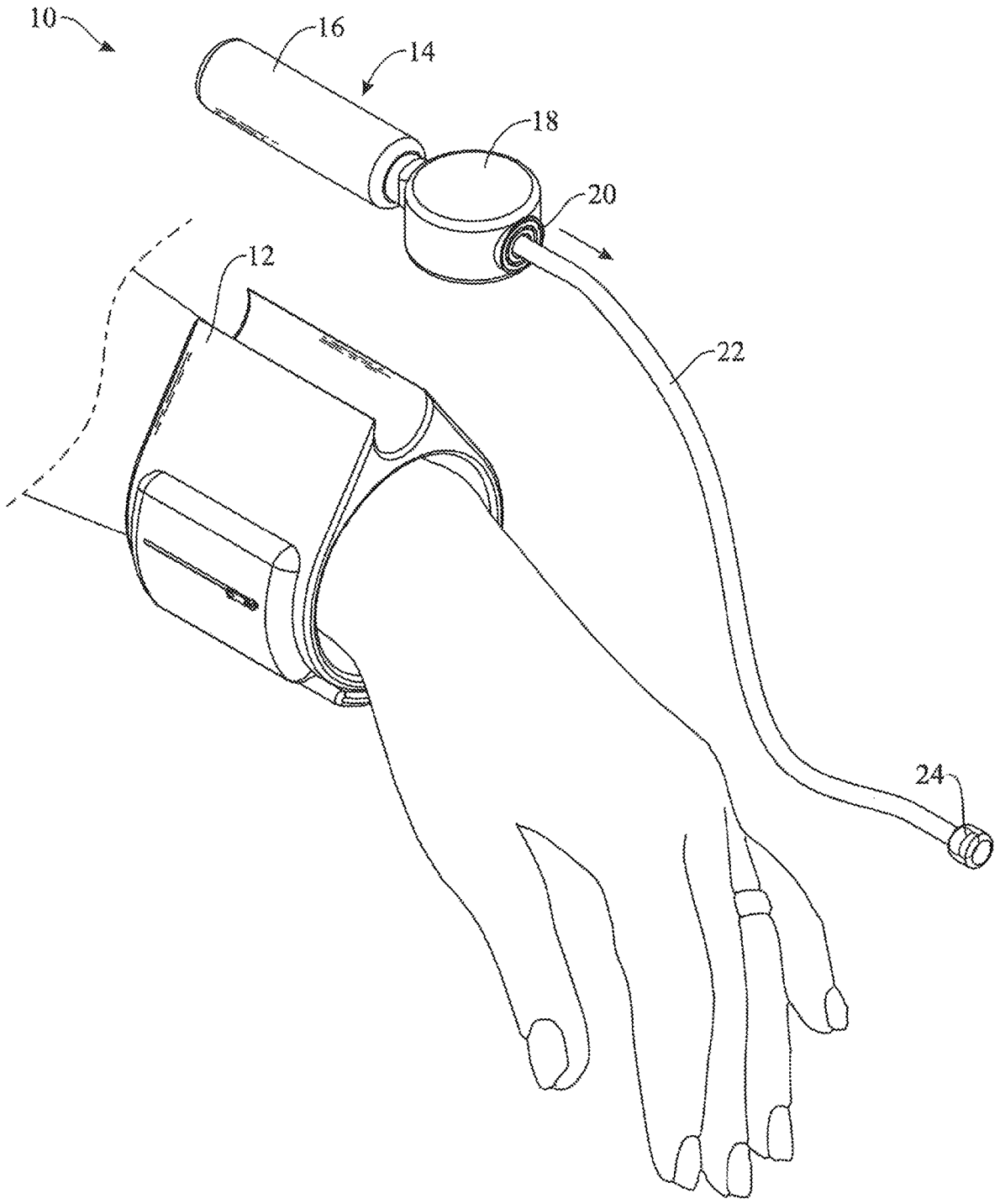
FIG. 4 presents a perspective view of jump roping system illustrated in FIG. 3, shown with a segment of rope being extended out of the housing through the inlet/outlet.

Moving on to FIG. 4, this figure illustrates how the segment of rope 22 is extended out of the housing 18 through the inlet/outlet 20. The user simply pulls the end of the rope 22, and the tapered design of the inlet/outlet 20 ensures a controlled extension and retraction of the rope 22, enhancing the safety and convenience of the system 10. This mechanism is designed to prevent the rope from becoming tangled or extending too quickly, which could pose a risk to the user.

Figure 5:
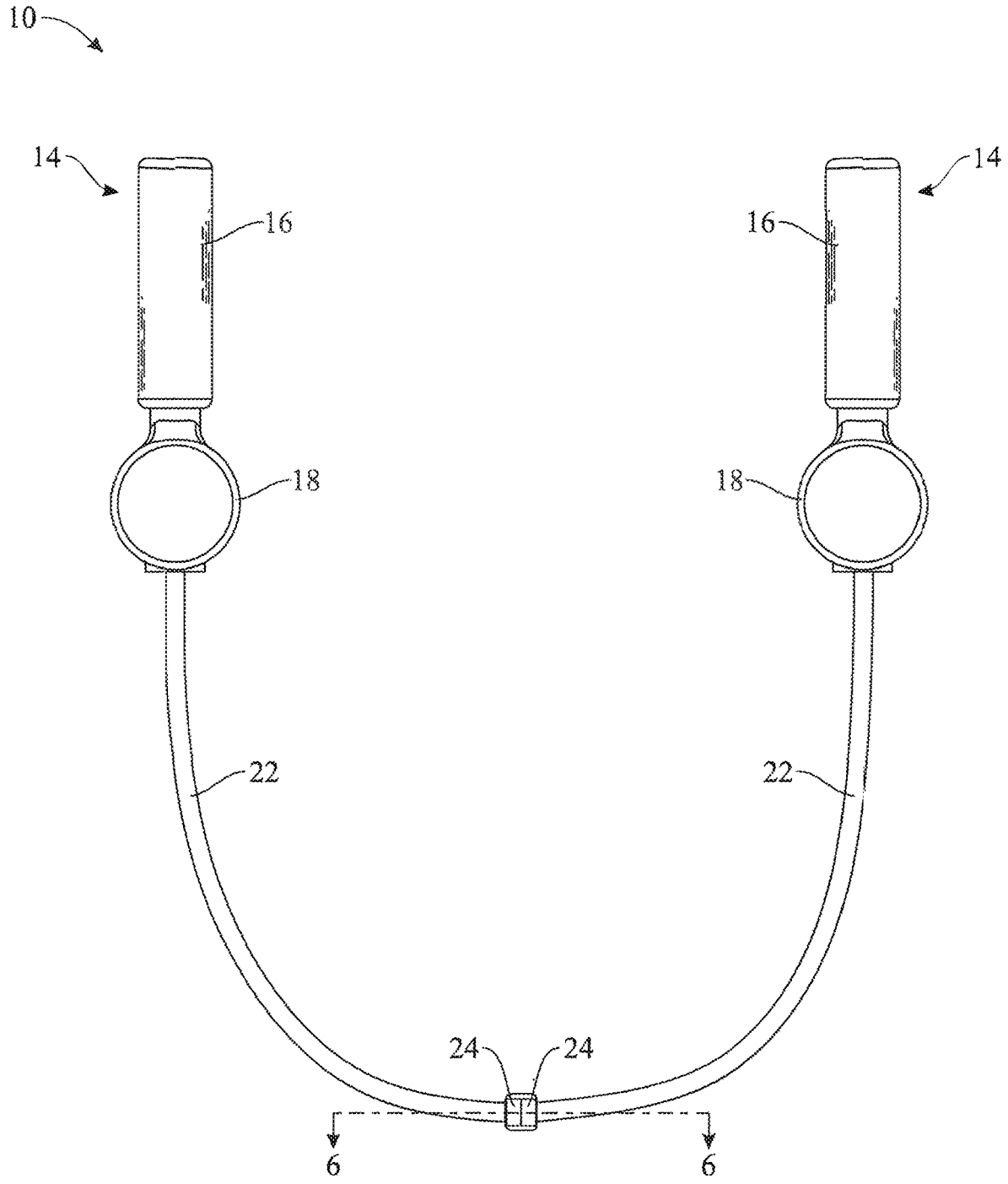
FIG. 5 presents a perspective view of jump roping system illustrated in FIG. 4, shown with each segment of rope extending out of the housing of each handle and being connected to each other.

As depicted in FIG. 5, each segment of rope 22 extends out of the housing 18 of each handle 14 and connects to each other. The magnets 24 at the end of each rope segment 22 attract each other to create a secure connection, thus forming a full-length jump rope. The user can adjust the length of the rope 22 according to their height and skill level, demonstrating the versatility of the system 10. This adjustability is important for ensuring that the jump rope can be used effectively by individuals of different heights and fitness levels.

Figure 6:
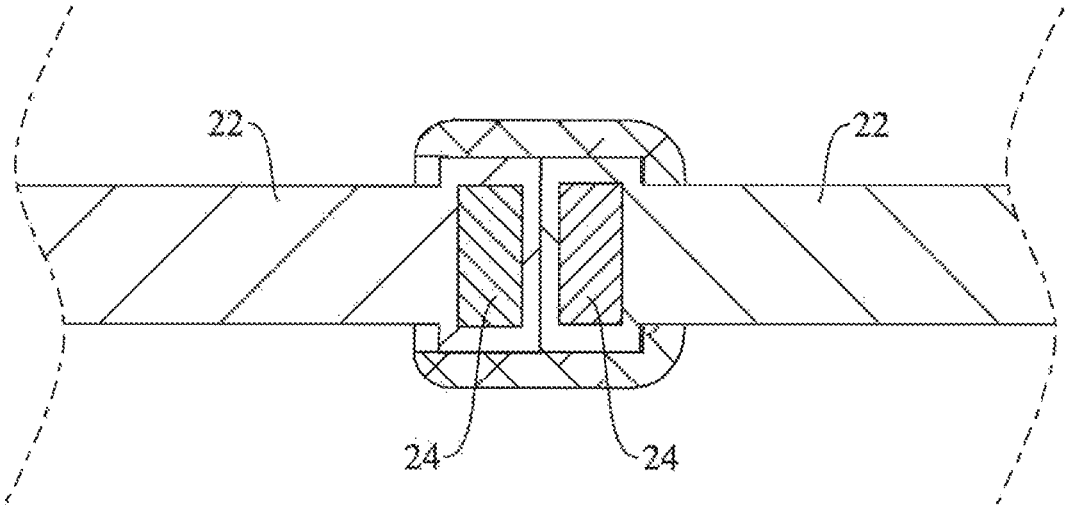
FIG. 6 presents a perspective view of jump roping system illustrated in FIG. 4, shown with each segment of rope extending out of the housing of each handle and being connected to each other.

FIG. 6 presents a cross-sectional view of the connected segments of ropes 22, revealing the internal magnets 24 at the end section of each segment of rope 22. This view provides a clear illustration of how the magnets 24 facilitate the connection of the rope segments 22, further demonstrating the innovative design of the jump roping system 10. The secure connection provided by the magnets 24 ensures that the rope remains stable and functional during use, enhancing the user's exercise experience.

Figure 7:
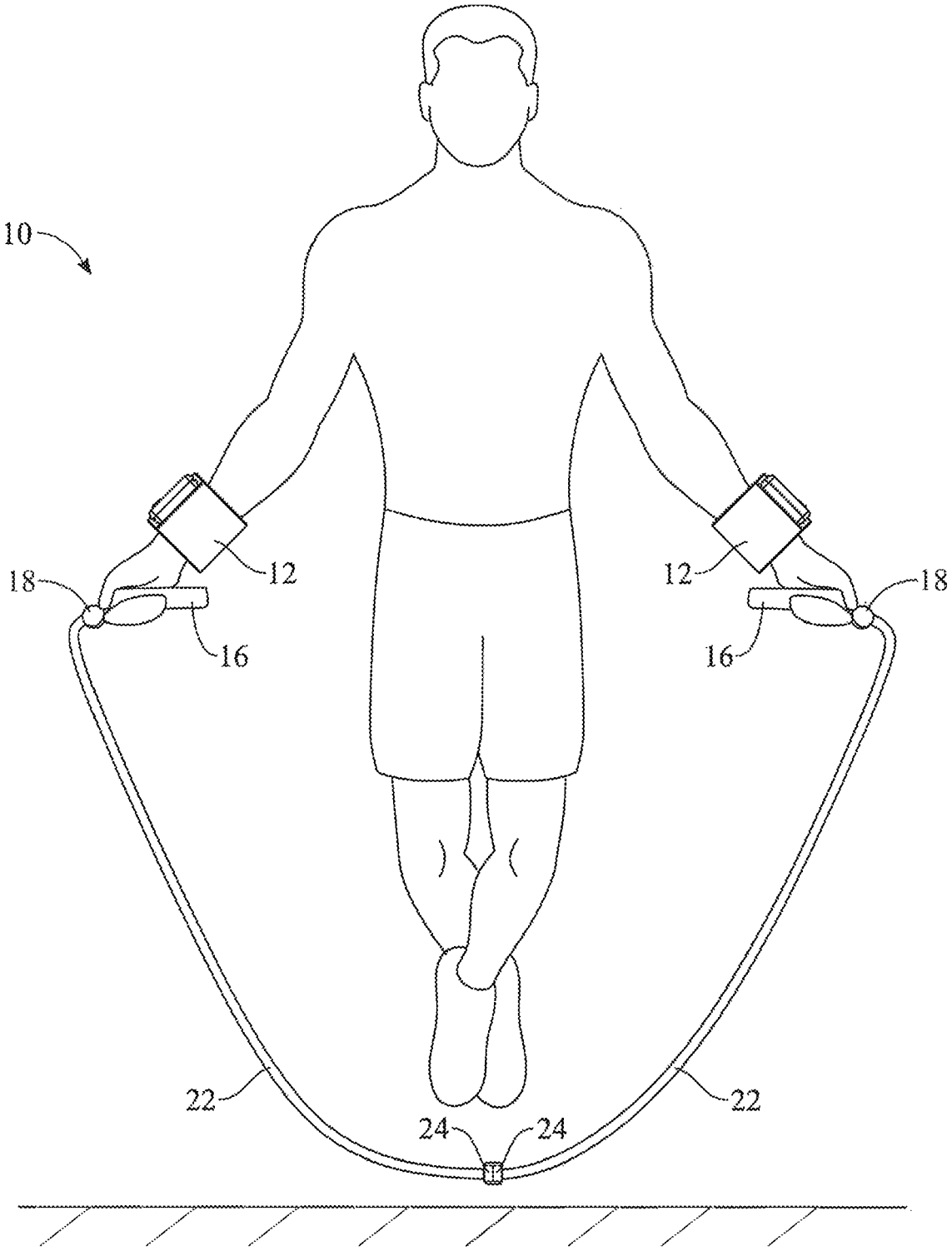
FIG. 7 presents a front view of the jump roping system illustrated in FIG. 1, shown with the system in use by a user.
Figure 8:
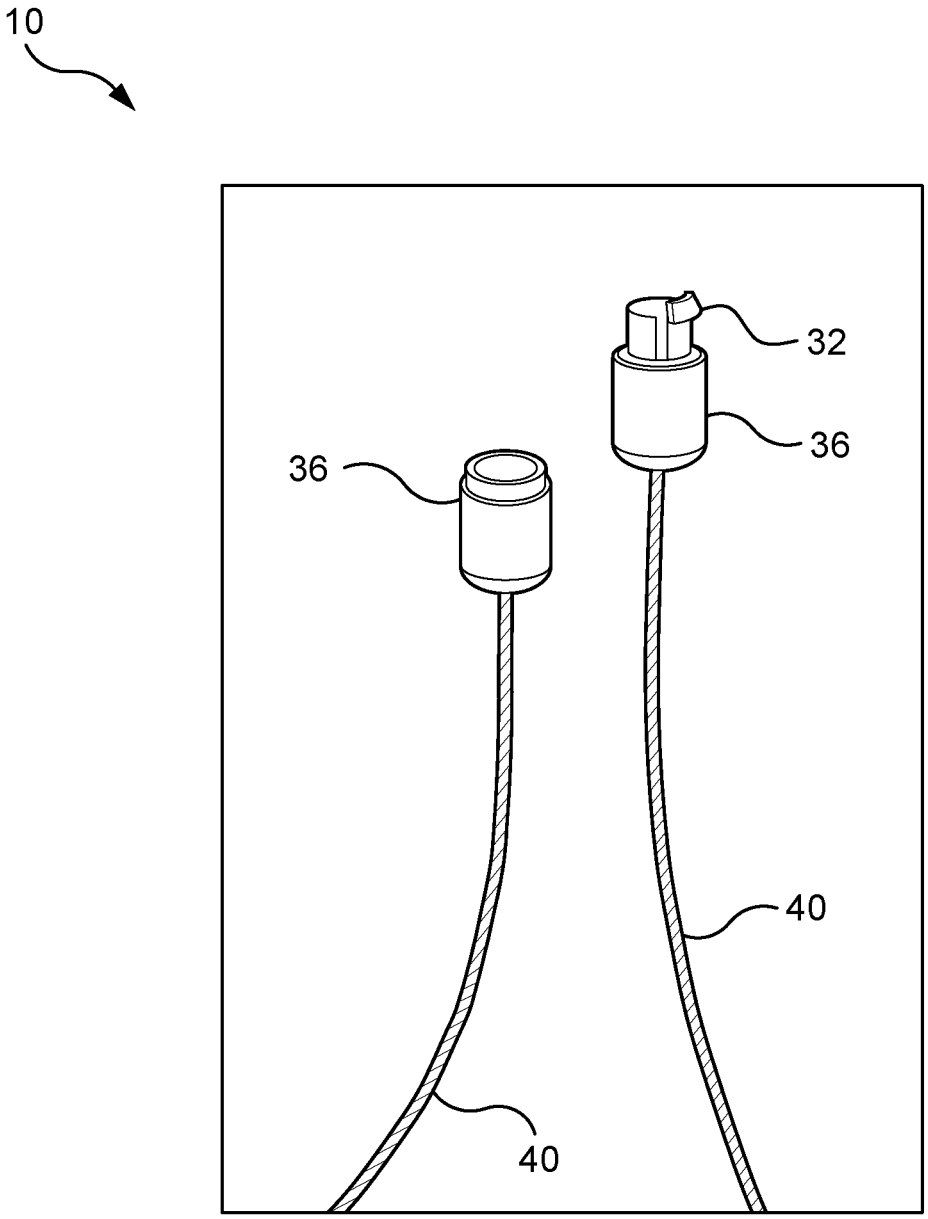
FIG. 8 presents a close-up view of the connector mechanism of the jump roping system, in accordance with an alternative embodiment of the invention, showing the male and female parts of the connector located at the ends of each rope segment, where the male connector has protruding elements that fit into corresponding slots on the female connector, ensuring a secure attachment when clicked together, allowing for easy yet secure connection and disconnection of the rope segments.
Figure 9:
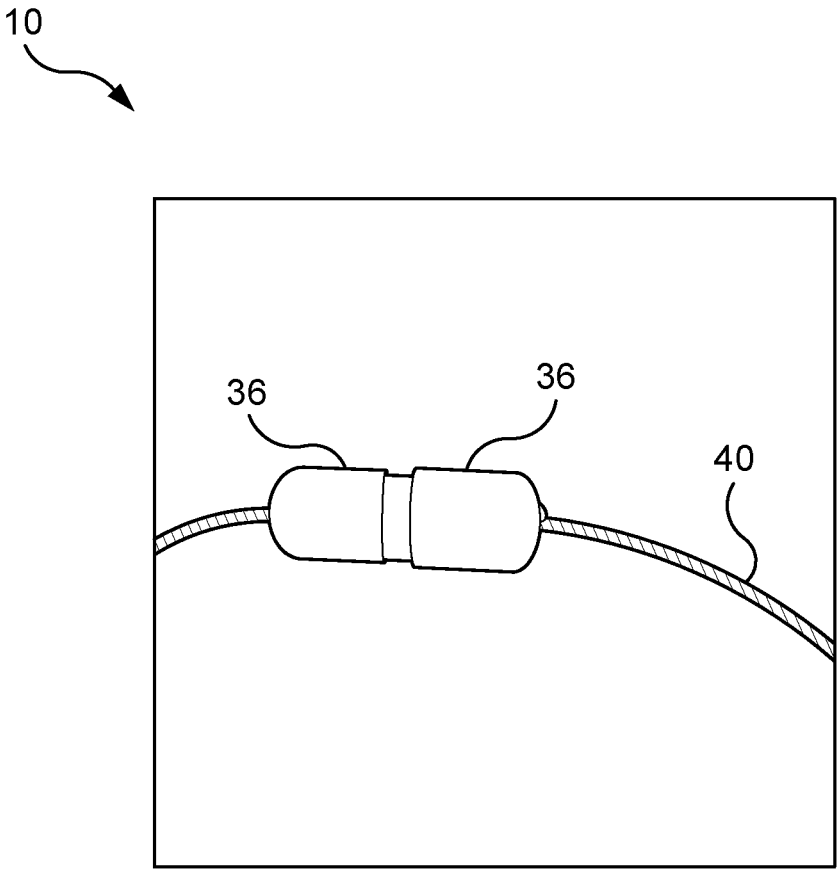
FIG. 9 presents a view of the jump roping system with the connector mechanism engaged, showing the male and female parts of the connector securely clicked together at the ends of each rope segment, demonstrating the secure attachment achieved when the connectors are properly engaged, enhancing the usability and stability of the jump roping system during exercise.
Figure 10:
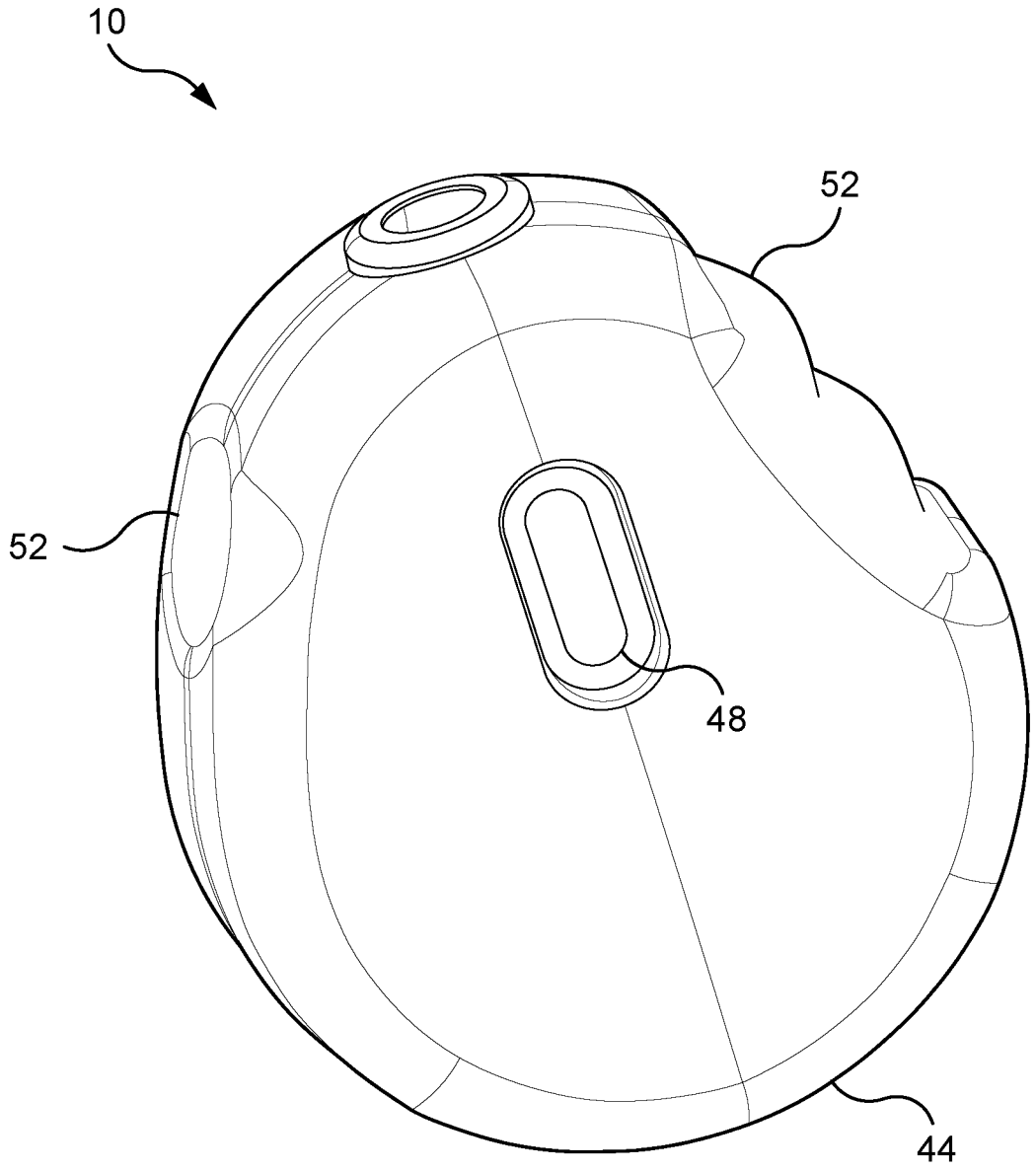
FIG. 10 presents a perspective view of the housing of the jump roping system, in accordance with an alternative embodiment of the invention, showing the ergonomic grip portion and the button mechanism for controlling the extension and retraction of the rope, with the cylindrical housing designed to fit comfortably in the user's hand and the button mechanism allowing for easy manipulation of the rope length during use.
Figure 11:
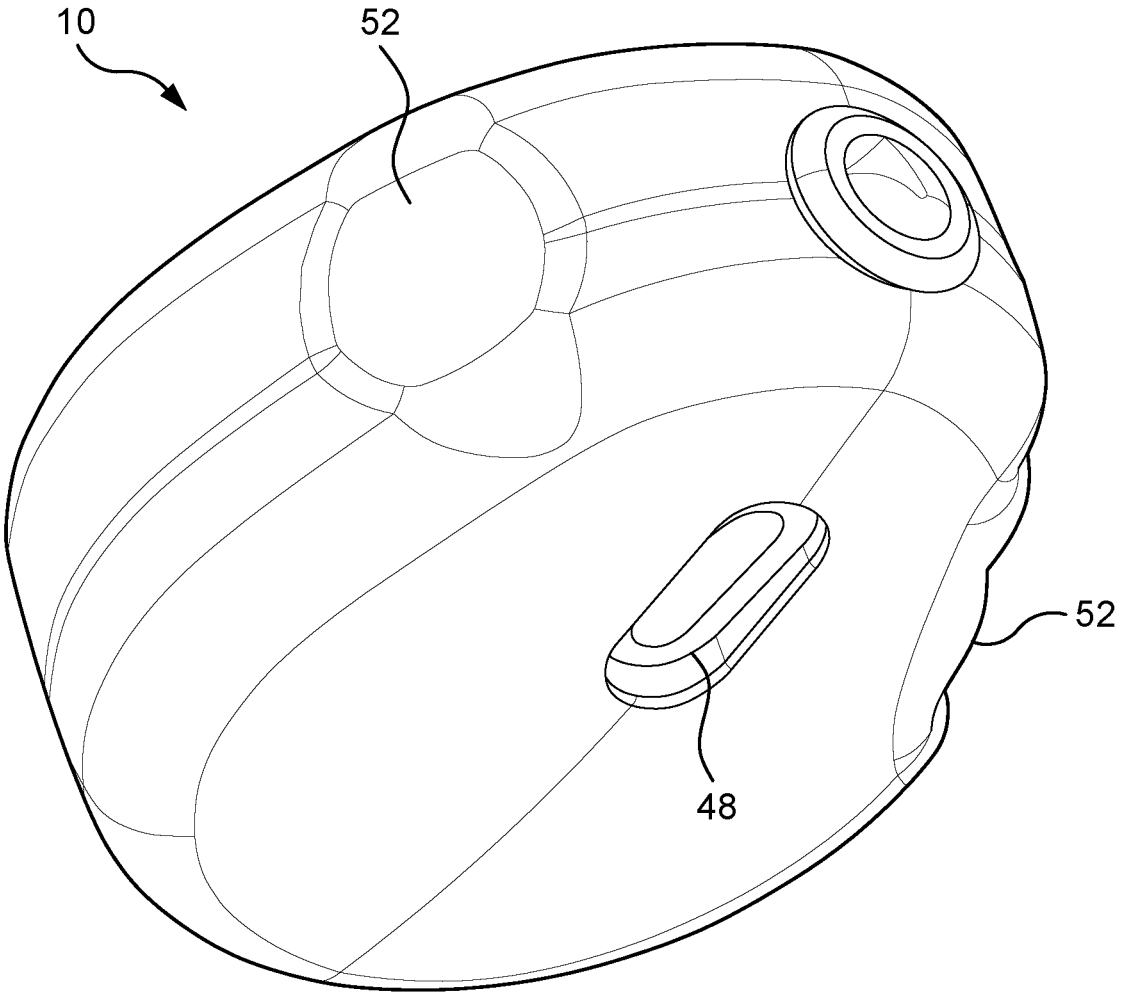
FIG. 11 presents another perspective view of the housing of the jump roping system, in accordance with an alternative embodiment of the invention, illustrating the opposite side of the housing from FIG. 10, further detailing the ergonomic grip portion and the button mechanism for controlling the extension and retraction of the rope, designed to fit comfortably in the user's hand and allow easy manipulation of the rope length during use.

Finally, FIG. 7 shows the jump roping system 10 in action. The user holds each handle 14 and swings the connected ropes 22 in a circular motion, just like a traditional jump rope. The use of the system 10 is as straightforward and intuitive as using a conventional jump rope, making it easy for both novices and experienced users to adopt. The ergonomic design of the handles 14 and the smooth operation of the rope 22 ensure that the system is comfortable and effective to use.

When the user completes their exercise routine, they can disconnect the ropes 22 by gently pulling the handles 14 apart. The rope segments 22 can then be recoiled back into the housings 18 of the handles 14. The handles 14 can then be attached back onto the wristbands 12 for easy storage and transportation, making the system 10 extremely convenient and user-friendly. The easy storage and transport features ensure that the system can be used effectively in various settings, from home workouts to outdoor exercises.

To use the system 10, the user starts by adjusting the wristbands 12 to fit securely around their wrists. The handles 14 are then removed from the wristbands 12, and the rope segments 22 are extended out of the housings 18 via the inlet/outlet 20. The user then connects the rope segments 22 together via the magnets 24 and starts their jump roping routine. When done, the user disconnects the ropes 22, recoils them back into the housings 18, and attaches the handles 14 back onto the wristbands 12. This simple and efficient process ensures that users can quickly and easily prepare the system for use and store it when not in use.

As best shown in FIGS. 8-11, in a second embodiment, the jump roping system 10 includes several enhancements to improve its functionality and user experience. In this embodiment, the rope segments 30 are connected using a click-and-lock mechanism 32 instead of magnets. The connectors 36 consist of male and female parts that click together to form a secure connection. To release the cords 40 from each other, the user must push a release button located at the connection point. This mechanism provides a secure and reliable connection while allowing for easy disconnection when needed.

The housing 44 in this second embodiment includes a button mechanism 48 that the user slides or presses to release the cord 40. The user extracts the cord until it reaches the desired length. To hold the cord in place, the user pushes the button back into its original position. To retract the cord into the housing, the user holds the button and slides or pushes it, allowing the cord to retract smoothly back into the housing. This mechanism ensures that the cord remains securely in place during use and can be easily retracted for storage.

In this embodiment, the housing 44 itself functions as the handle, eliminating the need for a separate hand-holdable portion. The housing includes an ergonomic grip 52 to enhance the user's hold and feel during use. The grip can be made from various materials, such as rubber or textured plastic, to provide a comfortable and secure hold. This design simplifies the system and reduces the number of components, making it more compact and easier to use.

Additionally, the rope segments 30 in this embodiment feature engraved numerical markings to indicate the length of the rope. These markings are laser-engraved onto the rope to ensure durability and visibility. The numerical markings allow users to easily adjust the length of the rope segments to match, ensuring that the rope is evenly balanced during use. This feature is particularly useful for users who need to make precise adjustments to the rope length for different exercises or user heights.

The wristbands in this embodiment can also be enhanced with additional features. For instance, the wristbands could include integrated storage pouches for small items, such as keys or earbuds. They could also feature reflective materials for increased visibility during outdoor workouts. These enhancements further increase the versatility and convenience of the jump roping system, making it suitable for a wide range of uses and environments.

While the preferred embodiments of the invention have been described above, it should be understood that there could be several alternative embodiments of the jump roping system. For instance, the connectors used to join the rope segments could be replaced with other types of connectors, such as hooks, buckles, or interlocking parts. The button mechanism for extending and retracting the rope could have different designs, such as a lever or a twist-lock mechanism. The housing itself could be detachable from the handle to facilitate cleaning or replacement of the rope. The wristbands could incorporate additional features, such as a digital display for tracking exercise metrics, a heartbeat monitor, or even a GPS tracker. These alternative embodiments underline the versatility and adaptability of the jump roping system, which can be modified to suit various user needs, preferences, and technological advancements.

In conclusion, the present invention provides a novel and improved jump roping system that is versatile, user-friendly, and efficient. The unique design of the wristbands and housings, the integration of mechanisms for neat storage and easy extension and retraction of the rope, the use of secure connectors for joining the rope segments, and the overall convenience in use and transportation collectively contribute to a jump roping system that is advantageous over traditional jump ropes and prior art. While the invention has been described in terms of preferred embodiments, it is apparent that other forms and modifications could be adopted by those skilled in the art. Accordingly, the scope of the invention should be limited only by the following claims, and not by the specific details or preferred embodiments described herein.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A jump roping system comprising:

a pair of adjustable wristbands, each configured to be worn around a user's wrist and incorporating an attachment point for securing a removable housing;

a pair of removable housings, each housing comprising a grip portion designed for hand-holding and a cylindrical housing affixed to the grip portion, the cylindrical housing structured to hold a portion of a jump rope in a coiled configuration and including a mechanism to control the extension and retraction of the rope segment; and a segment of rope located within each cylindrical housing, each rope segment having a connector at one end, the connectors being designed to securely attach the rope segments together and to allow for easy disconnection.

2. The jump roping system of claim 1, wherein the adjustable wristbands are made of an elastic material.

3. The jump roping system of claim 1, wherein the adjustable wristbands include a closure mechanism selected from the group consisting of a buckle, Velcro, and snap-fit.

4. The jump roping system of claim 1, wherein the attachment points on the wristbands are designed to secure the removable housings via a snap-fit mechanism.

5. The jump roping system of claim 1, wherein the grip portion of the removable housing includes a non-slip surface to enhance grip.

6. The jump roping system of claim 1, wherein the cylindrical housing includes a transparent portion allowing the user to visually assess the amount of rope remaining inside.

7. The jump roping system of claim 1, wherein the mechanism to control the extension and retraction of the rope segment includes a button that can be slid or pressed to release the rope segment.

8. The jump roping system of claim 7, wherein the button mechanism allows the user to extract the rope to a desired length and then lock the rope in place by returning the button to its original position.

9. The jump roping system of claim 7, wherein the button mechanism allows the user to retract the rope back into the cylindrical housing by holding the button and pushing or sliding it.

10. The jump roping system of claim 1, wherein the connectors at the ends of the rope segments consist of male and female parts that click together to form a secure connection.

11. The jump roping system of claim 10, wherein the connectors include a release mechanism that allows the rope segments to be separated by pushing at the connection point.

12. The jump roping system of claim 1, wherein the rope is made of a durable material selected from the group consisting of nylon, polyester, and polypropylene.

13. The jump roping system of claim 1, wherein the rope segments include numerical markings to indicate the length of the rope.

14. The jump roping system of claim 13, wherein the numerical markings are laser-engraved onto the rope segments.

15. The jump roping system of claim 1, wherein the cylindrical housing is made from a durable material selected from the group consisting of metal, hard plastic, and reinforced composites.

16. The jump roping system of claim 1, wherein the grip portion is ergonomically designed for a comfortable fit in the user's hand.

17. The jump roping system of claim 1, wherein the cylindrical housing includes a tapered inlet/outlet to restrict the rope from fully extending or completely recoiling into the housing.

18. The jump roping system of claim 1, wherein the wristbands further comprise integrated storage pouches for holding small items such as keys or earbuds.

19. A jump roping system comprising:

a pair of adjustable wristbands, each configured to be worn around a user's wrist and incorporating an attachment point for securing a removable housing;

a pair of removable housings, each housing comprising a grip portion designed for hand-holding, a cylindrical housing affixed to the grip portion, the cylindrical housing structured to hold a portion of a jump rope in a coiled configuration and including a button mechanism to control the extension and retraction of the rope segment, wherein the button mechanism allows the user to extract the rope to a desired length and then lock the rope in place by returning the button to its original position;

a segment of rope located within each cylindrical housing, each rope segment having a click-and-lock connector at one end, the connectors being designed to securely attach the rope segments together and to allow for easy disconnection by pushing a release button at the connection point; and numerical markings engraved on each rope segment to indicate the length of the rope, enabling the user to adjust the rope segments to match in length for balanced use during exercise.

20. A jump roping system comprising:

a pair of adjustable wristbands configured to be worn around a user's wrist, each wristband having a secure yet adjustable closure mechanism selected from the group consisting of a buckle, Velcro, or snap-fit;

a pair of removable housings, each housing comprising a grip portion designed for hand-holding, a cylindrical housing affixed to the grip portion, the cylindrical housing structured to hold a portion of a jump rope in a coiled configuration and including a button mechanism to control the extension and retraction of the rope segment, wherein the button mechanism allows the user to extract the rope to a desired length and then lock the rope in place by returning the button to its original position, and wherein the button mechanism allows the user to retract the rope back into the housing by holding the button and sliding or pushing it;

a segment of rope located within each cylindrical housing, each rope segment having a click-and-lock connector at one end, the connectors being designed to securely attach the rope segments together and to allow for easy disconnection by pushing a release button at the connection point;

numerical markings laser-engraved on each rope segment to indicate the length of the rope, enabling the user to adjust the rope segments to match in length for balanced use during exercise; and an ergonomic grip integrated into each housing to enhance the user's hold and feel during use, wherein the grip is made from a material selected from the group consisting of rubber and textured plastic.

* * * * *